US008651301B2

(12) United States Patent
Kiova et al.

(10) Patent No.: US 8,651,301 B2
(45) Date of Patent: Feb. 18, 2014

(54) METHOD OF CONTROLLING ROTATION SPEED OF MOTOR OF SPEED-CONTROLLABLE HOIST DRIVE, AND HOIST DRIVE

(75) Inventors: Jussi Kiova, Hyvinkää (FI); Janne Salomäki, Hyvinkää (FI)

(73) Assignee: Konecranes PLC, Hyvinkaa (FI)

( * ) Notice: Subject to any disclaimer, the term of this patent is extended or adjusted under 35 U.S.C. 154(b) by 559 days.

(21) Appl. No.: 12/997,810

(22) PCT Filed: Jun. 12, 2009

(86) PCT No.: PCT/FI2009/050505

§ 371 (c)(1),
(2), (4) Date: Dec. 13, 2010

(87) PCT Pub. No.: WO2009/156573

PCT Pub. Date: Dec. 30, 2009

(65) Prior Publication Data

US 2011/0089388 A1 Apr. 21, 2011

(30) Foreign Application Priority Data

Jun. 23, 2008 (FI) ..... 20085633

(51) Int. Cl.
*B66C 13/12* (2006.01)

(52) U.S. Cl.
USPC ..... 212/284; 212/270; 212/278

(58) Field of Classification Search
USPC ..... 212/270, 277–281, 284–290
See application file for complete search history.

(56) References Cited

U.S. PATENT DOCUMENTS

| | | | | | |
|---|---|---|---|---|---|
| 3,517,830 | A | * | 6/1970 | Virkkala | 212/275 |
| 3,612,486 | A | * | 10/1971 | Martin et al. | 254/267 |
| 3,921,818 | A | * | 11/1975 | Yamagishi | 212/275 |
| 4,304,337 | A | * | 12/1981 | Dummer | 212/308 |
| 4,520,778 | A | * | 6/1985 | Nanjo et al. | 123/352 |
| 4,556,830 | A | * | 12/1985 | Schwalm et al. | 388/806 |
| 4,756,432 | A | * | 7/1988 | Kawashima et al. | 212/275 |
| 4,917,206 | A | * | 4/1990 | Hara | 180/179 |
| 4,997,095 | A | * | 3/1991 | Jones et al. | 212/275 |
| 5,105,135 | A | * | 4/1992 | Nashiki et al. | 318/568.11 |
| 5,127,533 | A | * | 7/1992 | Virkkunen | 212/275 |

(Continued)

FOREIGN PATENT DOCUMENTS

| | | | |
|---|---|---|---|
| CN | 1826283 | A | 8/2006 |
| CN | 101067304 | A | 11/2007 |

(Continued)

*Primary Examiner* — Emmanuel M Marcelo
*Assistant Examiner* — Michael Gallion
(74) *Attorney, Agent, or Firm* — Birch, Stewart, Kolasch & Birch, LLP

(57) ABSTRACT

A method according to the invention of controlling a rotation speed of a motor of a speed-controllable hoist drive comprises receiving a lift speed instruction; forming a final speed instruction by using initial information containing the lift speed instruction; and using the final speed instruction as a speed instruction for the rotation speed of the motor of the speed-controllable hoist drive. The method further comprises monitoring a position derivative of an actual value of a cable force. The initial information for forming the final speed instruction comprises the position derivative of the actual value of the cable force.

13 Claims, 2 Drawing Sheets

(56) References Cited

U.S. PATENT DOCUMENTS

| | | | | | |
|---|---|---|---|---|---|
| 5,160,056 | A * | 11/1992 | Yoshimatsu et al. | 212/277 |
| 5,282,136 | A * | 1/1994 | Zui et al. | 701/50 |
| 5,296,791 | A * | 3/1994 | Hipp | 318/563 |
| 5,355,060 | A * | 10/1994 | Peterson | 318/432 |
| 5,371,452 | A * | 12/1994 | Kato | 318/610 |
| 5,392,935 | A * | 2/1995 | Kazama et al. | 212/278 |
| 5,529,193 | A * | 6/1996 | Hytonen | 212/275 |
| 5,550,733 | A * | 8/1996 | Yun et al. | 700/69 |
| 5,645,181 | A * | 7/1997 | Ichiba et al. | 212/281 |
| 5,671,912 | A * | 9/1997 | Langford et al. | 254/267 |
| 5,785,191 | A * | 7/1998 | Feddema et al. | 212/275 |
| 6,102,221 | A * | 8/2000 | Habisohn | 212/270 |
| 6,241,462 | B1 * | 6/2001 | Wannasuphoprasit et al. | 414/800 |
| 6,366,049 | B1 * | 4/2002 | Chen et al. | 318/799 |
| 6,474,922 | B2 * | 11/2002 | Bachman et al. | 414/21 |
| 7,239,106 | B2 * | 7/2007 | Rodnunsky et al. | 318/649 |
| 7,820,115 | B2 * | 10/2010 | Zatechka et al. | 422/400 |
| 8,005,598 | B2 * | 8/2011 | Terashima et al. | 701/50 |
| 2004/0164041 | A1 * | 8/2004 | Sawodny et al. | 212/273 |
| 2005/0017228 | A1 * | 1/2005 | Werner | 254/278 |
| 2007/0001158 | A1 * | 1/2007 | Hoffend | 254/331 |
| 2007/0023378 | A1 * | 2/2007 | Porma et al. | 212/275 |
| 2009/0272710 | A1 * | 11/2009 | Golder | 212/284 |
| 2011/0006025 | A1 * | 1/2011 | Schneider et al. | 212/273 |

FOREIGN PATENT DOCUMENTS

| | | | |
|---|---|---|---|
| EP | 0 578 280 | A2 | 1/1994 |
| JP | 5-268788 | A | 10/1993 |
| JP | 9-272689 | A | 10/1997 |
| WO | WO 02/070392 | A1 | 9/2002 |

* cited by examiner

METHOD OF CONTROLLING ROTATION SPEED OF MOTOR OF SPEED-CONTROLLABLE HOIST DRIVE, AND HOIST DRIVE

BACKGROUND OF THE INVENTION

The invention relates to controlling a rotation speed of a motor of a speed-controllable hoist drive.

When a load is lifted from the ground, both the load and the structure carrying the load are subjected to vertical vibrations. The vertical vibration is mainly caused by an impact load which is generated when the load is quickly lifted from the ground at a high lifting speed.

The impact load may be reduced by keeping the lifting speed low when removing the load from the ground. An experienced hoist operator may apply this method manually by reducing the lifting speed at a point of time when the load comes off the ground.

It is known to equip a hoist drive with a hoist controller arranged to detect the tightening of a cable and the load becoming airborne by monitoring a change in the cable force relative to time, i.e. the time derivative of the cable force. When the time derivative of the cable force becomes too high, the lifting speed is reduced. When the time derivative of the cable force becomes sufficiently low, the lifting speed is raised back to its original value. Such a controller enables quite good results to be achieved in connection with two-speed hoist drives.

A problem with the prevention of impact load based on monitoring the time derivative is that the method is not very well suited to speed-controllable hoist drives wherein the lifting speed may be anything between minimum and maximum speeds.

BRIEF DESCRIPTION OF THE INVENTION

An object of the invention is thus to provide a method of controlling the rotation speed of a motor of a speed-controllable hoist drive, and a hoist drive so as to enable the aforementioned problem to be alleviated. The object of the invention is achieved by a method and a hoist drive which are characterized by what is stated in the independent claims. Preferred embodiments of the invention are disclosed in the dependent claims.

The idea underlying the invention is that a position derivative of the actual value of the cable force is utilized in formation of a final speed instruction of a speed-controllable hoist drive. A position derivative of the cable force refers to a change in the cable force in relation to the position of a hoisting member.

An advantage of the invention is that by monitoring the position derivative of the actual value of the cable force, more reliable information is obtained on stages of a hoisting event than by using a method which is based on monitoring the time derivative of the cable force. The invention is suitable for use e.g. for indicating the airborneness of a load and for indicating the tightening of a cable.

BRIEF DESCRIPTION OF THE FIGURES

The invention is now described in closer detail in connection with the preferred embodiments and with reference to the accompanying drawings, in which.

DETAILED DESCRIPTION OF THE INVENTION

Figure 1:
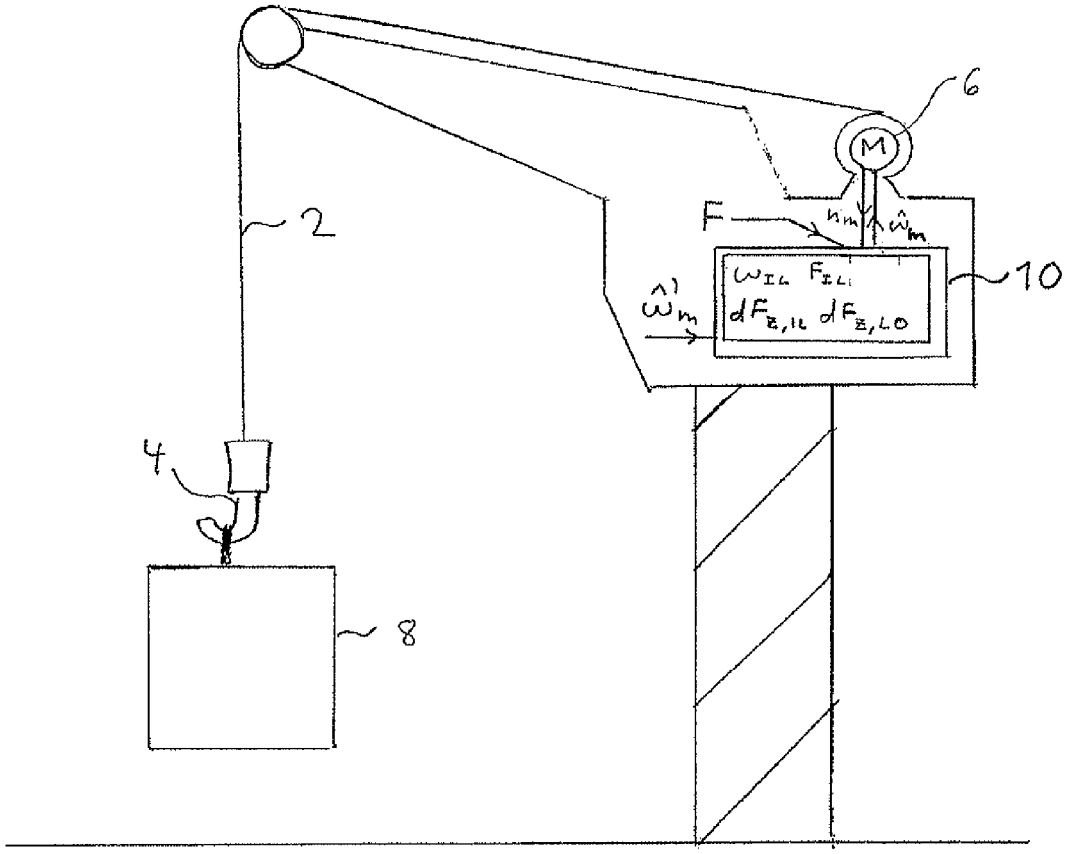
FIG. 1 shows a schematic view of a hoist drive according to an embodiment of the invention.

FIG. 1 shows a hoist drive comprising a cable 2, a hoisting member 4 connected with the cable, a speed-controllable motor 6 which is operationally connected to the cable 2 for lifting a load 8 by means of the hoisting member 4, and a hoist controller 10. The hoist controller 10 is arranged to receive a lift speed instruction $\hat{\omega}'_m$, to form a final speed instruction $\hat{\omega}_m$, and to control the rotation speed of the speed-controllable motor 6 by means of the final speed instruction $\hat{\omega}_m$.

The hoist drive further comprises means for determining an actual value F of a cable force directed to the cable 2, and means for determining position information of the hoisting member 4. The means for determining the actual value F of the cable force may comprise a strain gauge connected to a fastening point of the cable 2. The information on the actual value F of the cable force is taken to the hoist controller 10. The means for determining the position information of the hoisting member 4 may comprise a pulse sensor of the motor 6. The pulse sensor provides information $n_m$ relating to the rotation of the motor 6, which is taken to the hoist controller 10. The hoist controller 10 determines the position of the hoisting member 4 by using as initial information the information $n_m$ relating to the rotation of the motor 6 as well as a known transmission ratio between the rotation of the motor 6 and the position of the hoisting member 4.

The hoist controller 10 is arranged to determine the position derivative of the actual value of the cable force dF/dz by using as initial information the actual value F of the cable force and the position information of the hoisting member 4. The position derivative of the actual value of the cable force dF/dz thus describes a change in the actual value F of the cable force in relation to a change in the position z of the hoisting member 4. The hoist controller 10 is also arranged to monitor the position derivative of the actual value of the cable force dF/dz it determined, and to control the rotation speed of the motor 6 on the basis thereof. The hoist drive utilizes the values of the position derivative of the actual value of the cable force dF/dz for observing different stages of the load hoisting event.

The hoist controller 10 indicates the tightening of the cable 2 when predetermined conditions are met. The conditions on the basis of which the tightening of the cable is indicated comprise exceeding predetermined impact load limit value of the position derivative of the cable force $dF_{z,IL}$ and impact load limit value of the cable force $F_{IL}$. The hoist controller 10 is arranged in response to the indicated tightening of the cable to lower the value of the final speed instruction $\hat{\omega}_m$ to be equal to a predetermined impact load limit value of the speed instruction $\omega_{IL}$.

In situations where no tightening of the cable 2 has been indicated, the hoist controller 10 is arranged to form a final speed instruction $\hat{\omega}_m$ which, within the limits of predetermined parameters, follows the lift speed instruction $\hat{\omega}'_m$. The speed of change of the final speed instruction $\hat{\omega}_m$ is kept within predetermined limits, i.e. the final speed instruction $\hat{\omega}_m$ does not change stepwise even if the lift speed instruction $\hat{\omega}'_m$ would.

In the hoist controller 10, as one condition for the indication of the tightening of the cable 2 the exceeding of the impact load limit value of the cable force $F_{IL}$ is used e.g. because this procedure enables an incorrect indication of the tightening of the cable 2 to be prevented in a situation where the determined position derivative of the actual value of the cable force dF/dz is erroneous. The use of the exceeding of the impact load limit value of the cable force $F_{IL}$ as a condition for the indication of the tightening of the cable is thus a back-up condition. In an embodiment of the invention, the predetermined conditions on the basis of which the tightening of the cable is indicated comprise exceeding the impact load limit value of the position derivative of the cable force $dF_{z,IL}$ but they do not comprise exceeding the impact load limit value of the cable force $F_{IL}$.

The hoist controller 10 indicates the airborneness of the load at a point of time which follows the indication of the tightening of the cable and at which point of time the position derivative of the actual value of the cable force dF/dz drops below a predetermined load lift-off limit value $dF_{z,LO}$. An inequality $dF_{z,IL}>dF_{z,LO}>0$ applies to the limit values of the position derivative of the cable force. In response to the indicated airborneness of the load the hoist controller 10 raises the value of the final speed instruction $\hat{\omega}_m$ to be equal to the lift speed instruction $\hat{\omega}'_m$.

The load lift-off limit value $dF_{z,LO}$ of the position derivative is hoist drive specific initial information which has been fed in advance to the hoist controller 10. The impact load limit value of the position derivative of the cable force $dF_{z,IL}$, impact load limit value of the cable force $F_{IL}$, and the impact load limit value of the speed instruction $\omega_{IL}$ are also hoist drive specific initial information.

In an embodiment of the invention, the position derivative of the actual value of the cable force dF/dz is only used for indicating the airborneness of the load, i.e. the airborneness of the load is indicated when the position derivative of the actual value of the cable force dF/dz drops below the predetermined load lift-off limit value $dF_{z,LO}$. In this embodiment, the tightening of the cable is indicated by means of a quantity other than the position derivative of the actual value of the cable force dF/dz. The tightening of the cable may be indicated e.g. as a response to the predetermined impact load limit value of the cable force $F_{IL}$ being exceeded.

Figure 2:
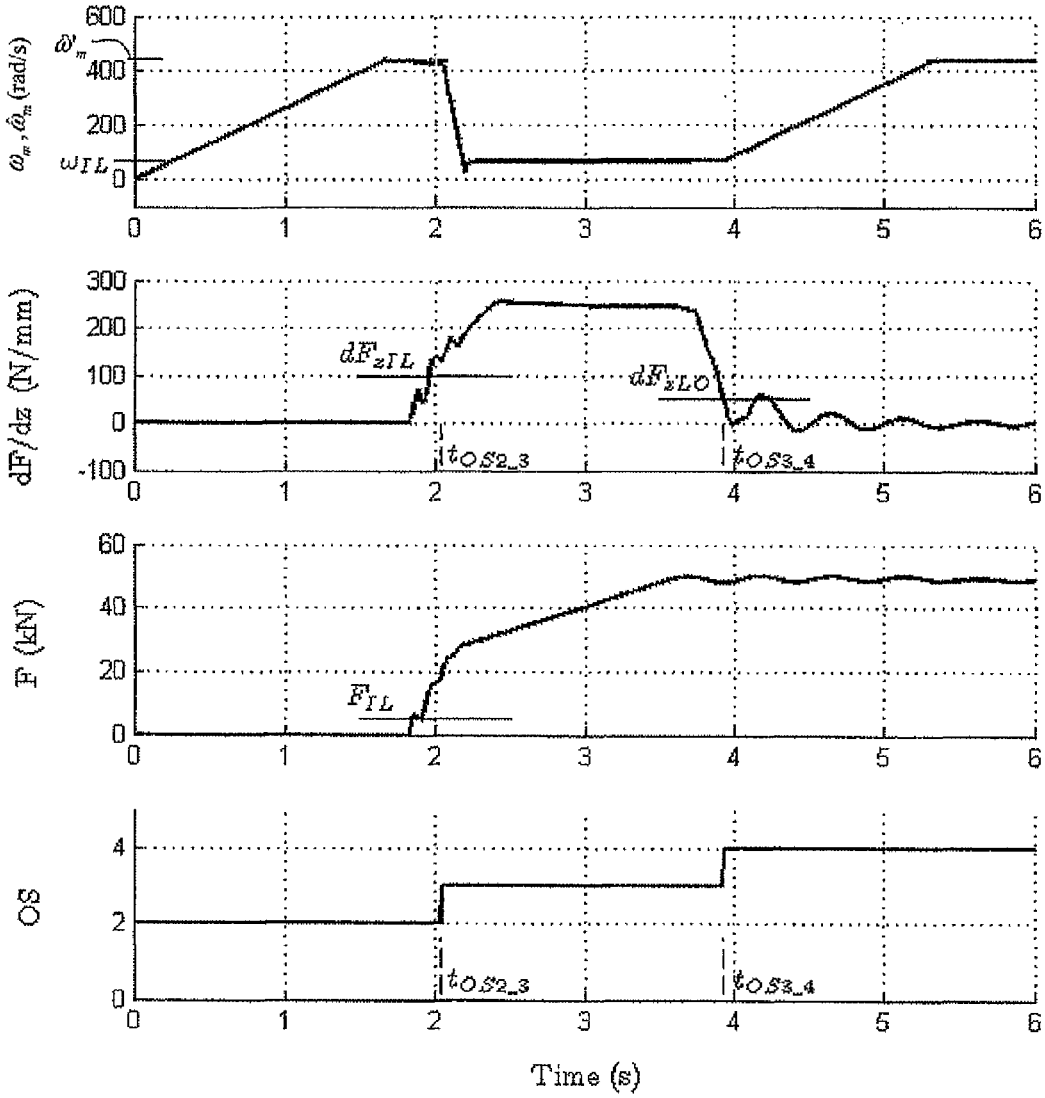
FIG. 2 shows a simulated hoisting event of the hoist drive of FIG. 1.

FIG. 2 shows four graphs that have been drawn on the basis of the simulated hoisting event of the hoist drive of FIG. 1. The first graph shows the final speed instruction $\hat{\omega}_m$ and the rotation speed $\omega_m$ of the speed-controllable motor 6. The second graph shows the position derivative of the actual value of the cable force dF/dz. The third graph shows the actual value of the cable force F. The fourth graph shows the operation state OS of the hoist drive. All the four graphs of FIG. 2 are shown as a function of time, the unit on the horizontal axis being a second.

At a time t=0, when the final speed instruction $\hat{\omega}_m$ and the rotation speed $\omega_m$ are at zero, a lift speed instruction $\hat{\omega}'_m$, which is slightly over 400 rad/s, is brought to the hoist controller 10. According to the first graph of FIG. 2, the hoist controller 10 starts to increase the final speed instruction $\hat{\omega}_m$ such that the final speed instruction $\hat{\omega}_m$ increases by an angular acceleration of $\alpha_{acc}=260$ rad/s$^2$. When the final speed instruction $\hat{\omega}_m$ reaches the lift speed instruction $\hat{\omega}'_m$, the final speed instruction $\hat{\omega}_m$ stops increasing.

At a time $t_{OS2_3}$ the conditions for the indication of the tightening of the cable 2 are met, i.e. the actual value of the cable force F is above impact load limit value of the cable force $F_{IL}=5000$N, and the position derivative of the actual value of the cable force dF/dz is above impact load limit value of the position derivative of the cable force $dF_{z,IL}=100$ N/mm. It can be seen in the third graph that the actual value of the cable force F has actually already exceeded the impact load limit value of the cable force $F_{IL}$ earlier, i.e. the crucial event as far as the indication of the tightening of the cable is concerned is the rise of the position derivative of the actual value of the cable force dF/dz above the impact load limit value of the position derivative of the cable force $dF_{z,IL}$.

When the tightening of the cable 2 has been indicated, the hoist controller 10 starts to decrease the final speed instruction $\hat{\omega}_m$ such that the final speed instruction decreases by an angular acceleration $\alpha_{dec_f}$ towards the impact load limit value of the speed instruction $\omega_{IL}$. The absolute value of the angular acceleration $\alpha_{dec_f}$ is substantially higher than the absolute value of the angular acceleration $\alpha_{acc}$, i.e. after the hoist controller 10 has indicated the tightening of the cable the rotation speed of the motor 6 is dropped quickly. The high angular deceleration is to ensure that the final speed instruction $\hat{\omega}_m$ has enough time to reach the impact load limit value of the speed instruction $\omega_{IL}$ before the load comes off the ground. When the final speed instruction $\hat{\omega}_m$ reaches the impact load limit value of the speed instruction $\omega_{IL}=65$ rad/s, the final speed instruction $\hat{\omega}_m$ stops decreasing.

In theory, when the hoist controller 10 indicates the tightening of the cable, the final speed instruction $\hat{\omega}_m$ could be dropped directly to the impact load limit value of the speed instruction $\omega_{IL}$, but in a real hoist drive this could cause e.g. the overcurrent protector of the frequency converter feeding the motor to go off. Consequently, in several embodiments, it is justified to slow down the final speed instruction to the impact load limit value of the speed instruction by using finite deceleration.

It can be seen in the second and third graphs of FIG. 2 that both the actual value of the cable force F and the position derivative of the actual value of the cable force dF/dz still increase after the time $t_{OS2_3}$ and continue increasing even after the final speed instruction $\hat{\omega}_m$ has reached the impact load limit value of the speed instruction $\omega_{IL}$.

At a time $t_{OS3_4}$ the condition for the indication of the load being airborne is met, i.e. the position derivative of the actual value of the cable force dF/dz drops below a predetermined load lift-off limit value $dF_{z,LO}=50$ N/mm at a time which is later than a time $t_{OS2_3}$ corresponding with the indication of the tightening of the cable. In such a case, the hoist controller 10 starts to increase the final speed instruction $\hat{\omega}_m$ such that the final speed instruction increases by the angular acceleration $\alpha_{acc}$ towards the lift speed instruction $\hat{\omega}'_m$. When the final speed instruction $\hat{\omega}_m$ reaches the lift speed instruction $\hat{\omega}'_m$, the final speed instruction $\hat{\omega}_m$ stops increasing.

It can be seen in the first graph of FIG. 2 that the rotation speed $\omega_m$ of the speed-controllable motor 6 follows relatively tightly the final speed instruction $\hat{\omega}_m$, i.e. the graphs are for the most of the time substantially on top of one another. The graph of the final speed instruction $\hat{\omega}_m$ consists of clear straight lines, and the rotation speed $\omega_m$ of the speed-controllable motor 6 is shown as a distortion of these straight lines. The rotation speed $\omega_m$ of the speed-controllable motor 6 differs from the final speed instruction $\hat{\omega}_m$ significantly really only in a situation wherein the final speed instruction $\hat{\omega}_m$ reaches, as it decreases, the impact load limit value of the speed instruction $\omega_{IL}$. In this situation, the rotation speed $\omega_m$ of the motor 6 drops temporarily clearly below the impact load limit value of the speed instruction $\omega_{IL}$.

The fourth graph of FIG. 2 shows the operation state OS of the hoist drive at different times. At first, the hoist drive is in operation state OS2, where the hoist controller 10 interprets the hoisting member 4 to be empty. At a time $t_{OS2_3}$ the hoist drive proceeds from operation state OS2 to operation state OS3, where the hoist controller 10 interprets the cable 2 being tightened. At a time $t_{OS3_4}$ the hoist drive proceeds from operation state OS3 to operation state OS4, where the hoist controller 10 interprets that the load is airborne.

In the simulated hoisting event of FIG. 2, the lift speed instruction $\hat{\omega}'_m$ stays constant all the time. It is, however, clear that the method according to the invention is also usable in a situation where the lift speed instruction varies during the hoisting event. For instance if after the indication of the tightening of the cable but before the final speed instruction $\hat{\omega}_m$ reaches the impact load limit value of the speed instruction $\omega_{IL}$ the lift speed instruction $\hat{\omega}'_m$ would drop below the impact load limit value of the speed instruction $\omega_{IL}$, the hoist controller 10 would not stop decreasing the final speed instruction at the impact load limit value of the speed instruction $\omega_{IL}$ but would decrease the final speed instruction $\hat{\omega}_m$ to the level of a new lift speed instruction. In other words, after the hoist controller 10 has indicated the tightening of the cable, it drops the final speed instruction at least to the level of the impact load limit value of the speed instruction $\omega_{IL}$. Correspondingly, after the hoist controller 10 has indicated the airborneness of the load, it starts to increase the value of the final speed instruction $\hat{\omega}_m$ only in situations where the lift speed instruction is higher than the impact load limit value of the speed instruction $\omega_{IL}$.

Since the method according to the invention enables disadvantageously high impact loads to be prevented automatically, the lift speed instruction to be fed to the hoist controller may, when the load is being lifted from the ground, even equal the maximum allowable rotation speed of the motor of the hoist drive. It is thus possible to lift the load smoothly from the ground even irrespectively of the experience and occupational skills of the operator of the hoist drive. This is why the method according to the invention is also well suited for automatic hoists as well.

In FIG. 1, the hoisting member 4 is a hoisting hook. In alternative embodiments of the invention, the hoisting member may be any member enabling a load to be grabbed, such as a hoisting anchor, a hoisting fork or a magnetic hoisting member.

The position of the hoisting member 4 is hereinabove indicated by 'z', which in many contexts refers to a vertical dimension. It is clear, however, that the utilization of the invention is by no means limited to embodiments wherein the load moves in the vertical direction only.

It is obvious to one skilled in the art that the basic idea of the invention may be implemented in many different ways. The invention and its embodiments are thus not restricted to the above-described examples but they may vary within the scope of the claims.

The invention claimed is:

1. A method of controlling a rotation speed of a motor of a speed-controllable hoist drive, the hoist drive comprising a cable, a hoisting member connected to the cable, and a speed-controllable motor which is operationally connected to the cable for lifting a load by means of the hoisting member, the method comprising receiving a lift speed instruction ($\hat{\omega}'_m$);

forming a final speed instruction ($\hat{\omega}_m$) by using initial information containing the lift speed instruction ($\hat{\omega}'_m$);

using the final speed instruction ($\hat{\omega}_m$) as a speed instruction for the rotation speed of the motor of the speed-controllable hoist drive;

the method further comprising monitoring a position derivative of an actual value of a cable force (dF/dz), and the initial information for forming the final speed instruction ($\hat{\omega}_m$) comprising the position derivative of the actual value of the cable force (dF/dz), which is a derivative of an actual value of a cable force with respect to a position of the hoisting member, the position of the hoisting member being determined based on information ($n_m$) relating to rotation of the motor.

2. A method as claimed in claim 1, further comprising indicating airborneness of the load when predetermined conditions are met, the conditions comprising that the position derivative of the actual value of the cable force (dF/dz) drops below a predetermined load lift-off limit value ($dF_{z,LO}$);

increasing, in response to the indicated load airborneness, a value of the final speed instruction ($\hat{\omega}_m$) to equal the lift speed instruction ($\hat{\omega}'_m$).

3. A method as claimed in claim 2, further comprising indicating tightening of the cable at a time ($t_{OS2_3}$) at which predetermined conditions are met; and the predetermined conditions for the indication of the airborneness of the load comprising that a time ($t_{OS3_4}$) at which the airborneness of the load is indicated is later than the time ($t_{OS2_3}$) at which the tightening of the cable is indicated.

4. A method as claimed in claim 3, wherein the predetermined conditions for the indication of the tightening of the cable comprising exceeding a predetermined impact load limit value of the position derivative of the cable force ($dF_{z,IL}$).

5. A method as claimed in claim 3, wherein the predetermined conditions for the indication of the tightening of the cable comprising exceeding a predetermined impact load limit value of the cable force ($F_{IL}$).

6. A method as claimed in claim 3, wherein decreasing, in response to the indicated tightening of the cable, the value of the final speed instruction ($\hat{\omega}_m$) to equal a predetermined impact load limit value of the speed instruction ($\omega_{IL}$), which is lower than the lift speed instruction ($\hat{\omega}'_m$).

7. A method as claimed in claim 1, further comprising indicating the tightening of the cable when predetermined conditions are met, the conditions comprising exceeding the predetermined impact load limit value of the position derivative of the cable force ($dF_{z,IL}$);

decreasing, in response to the indicated tightening of the cable, the value of the final speed instruction ($\hat{\omega}_m$) to equal the predetermined impact load limit value of the speed instruction ($\omega_{IL}$), which is lower than the lift speed instruction ($\hat{\omega}'_m$).

8. A hoist drive comprising a cable, a hoisting member connected to the cable, a speed-controllable motor which is operationally connected to the cable for lifting a load by means of the hoisting member, and a hoist controller, the hoist controller being arranged to receive a lift speed instruction ($\hat{\omega}'_m$);

form a final speed instruction ($\hat{\omega}_m$) by using initial information containing the lift speed instruction ($\hat{\omega}'_m$);

control a rotation speed of the speed-controllable motor by means of the final speed instruction ($\hat{\omega}_m$);

the hoist drive wherein the hoist controller is further arranged to monitor a position derivative of an actual value of a cable force, (dF/dz) and the initial information for forming the final speed instruction ($\hat{\omega}_m$) comprises the position derivative of the actual value of the cable force (dF/dz), which is a derivative of an actual value of a cable force with respect to a position of the hoisting member, the position of the hoisting member being determined based on information ($n_m$) relating to rotation of the motor.

9. A hoist drive as claimed in claim 8, wherein the hoist controller is further arranged to indicate airborneness of the load when predetermined conditions are met, the conditions comprising that the position derivative of the actual value of the cable force (dF/dz) drops below a predetermined load lift-off limit value ($dF_{z,LO}$);

increase, in response to the indicated load airborneness, a value of the final speed instruction ($\hat{\omega}_m$) to equal the lift speed instruction ($\hat{\omega}'_m$).

10. A hoist drive as claimed in claim 8, wherein the hoist controller is further arranged to indicate tightening of the cable when predetermined conditions are met, the conditions comprising exceeding a predetermined impact load limit value of the position derivative of the cable force ($dF_{z,IL}$);

decrease, in response to the indicated tightening of the cable, the value of the final speed instruction ($\hat{\omega}_m$) to equal the predetermined impact load limit value of the speed instruction ($\hat{\omega}_{IL}$).

11. A method as claimed in claim 4, wherein the predetermined conditions for the indication of the tightening of the cable comprising exceeding a predetermined impact load limit value of the cable force ($F_{IL}$).

12. A method as claimed in claim 4, wherein decreasing, in response to the indicated tightening of the cable, the value of the final speed instruction ($\hat{\omega}_m$) to equal a predetermined impact load limit value of the speed instruction ($\omega_{IL}$), which is lower than the lift speed instruction ($\hat{\omega}'_m$).

13. A method as claimed in claim 5, wherein decreasing, in response to the indicated tightening of the cable, the value of the final speed instruction ($\hat{\omega}_m$) to equal a predetermined impact load limit value of the speed instruction ($\omega_{IL}$), which is lower than the lift speed instruction ($\hat{\omega}'_m$).

* * * * *